US007623802B2

(12) United States Patent
Takagi et al.

(10) Patent No.: US 7,623,802 B2
(45) Date of Patent: Nov. 24, 2009

(54) FIXING DEVICE FOR IMAGE FORMING APPARATUS TO CONTROL POWER OF HEATING SOURCE

(75) Inventors: Osamu Takagi, Chofu (JP); Satoshi Kinouchi, Shinjuku-ku (JP); Yoshinori Tsueda, Fuji (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 73 days.

(21) Appl. No.: 11/736,078

(22) Filed: Apr. 17, 2007

(65) Prior Publication Data

US 2008/0260404 A1 Oct. 23, 2008

(51) Int. Cl.
*G03G 15/20* (2006.01)

(52) U.S. Cl. ..... 399/67

(58) Field of Classification Search ..... 399/67, 399/46, 69

See application file for complete search history.

(56) References Cited

U.S. PATENT DOCUMENTS 5,051,780 A * 9/1991 Stelter et al. ..... 399/70
2002/0172536 A1* 11/2002 Hirst et al. ..... 399/328
2004/0156661 A1* 8/2004 Kagawa et al. ..... 399/328
2004/0258427 A1* 12/2004 Takahashi ..... 399/69

FOREIGN PATENT DOCUMENTS

JP 06095541 A * 4/1994

* cited by examiner

*Primary Examiner*—Quana M Grainger
(74) *Attorney, Agent, or Firm*—Turocy & Watson, LLP

(57) ABSTRACT

A fixing device of this invention enables variable control of power to be supplied to a heat roller side or a press roller side in accordance with the temperature of the heat roller and the press roller while each mode is carried out. In a copy mode, the temperature of the heat roller and the press roller is finely controlled. In a copy standby mode, only the power required for maintaining a set temperature is supplied.

19 Claims, 4 Drawing Sheets

FIXING DEVICE FOR IMAGE FORMING APPARATUS TO CONTROL POWER OF HEATING SOURCE

BACKGROUND OF THE INVENTION

1. Field of the Invention

The present invention relates to a fixing device in an image forming apparatus for fixing onto a sheet paper, by heating and pressurizing, a toner image formed in the image forming apparatus using an electrophotographic process such as a copy machine, printer or facsimile, and a control method thereof.

2. Description of the Background

As a fixing device incorporated in an image forming apparatus using an electrophotographic process such as a copy machine, printer or facsimile, there is a fixing device that fixes a toner image on a sheet paper by heating and pressurizing. In such a fixing device, a sheet paper is inserted between a pair of rollers including a heat roller and a press roller, or in a nipping part formed between similar belts, and a toner image is fixed thereon by being heated and pressurized. Meanwhile, a full-color toner image formed by superimposed toner images of plural colors has a toner layer thickness that is several times larger than that of a monochrome toner image.

Therefore, when the temperature of the heat roller is raised to melt the thick toner layer, only the surface of the toner layer melts excessively. If only the surface of the toner layer melts excessively, a high-temperature offset may occur. Moreover, for a color image, a difference in the way of melting of the toner layer causes a color difference in the image and predetermined image quality cannot be acquired. That is, there is a need to melt the color toner layer for preventing the color difference.

Thus, in a conventional, as a color image fixing device, there is a device that heats a heat roller and also heats a press roller supporting the rear side of a sheet paper. This conventional fixing device can evenly melt a toner layer by heating the toner layer from both above and below. Also, the conventional fixing device can prevent a high-temperature offset of the toner.

However, also in such a conventional fixing device, heating control of the heat roller and the press roller is only on-off control of the heating source by application of predetermined power for each operation mode. Therefore, the heat roller and the press roller tend to have a temperature ripple and this temperature ripple may cause a color difference in the fixed image.

Meanwhile, recently, energy saving is demanded in an image forming apparatus. In the image forming apparatus, the power consumption by the fixing device is large and the energy saving in the fixing device largely affects the energy saving in the entire apparatus. Conventionally, when the power source of the image forming apparatus is turned on, power is also supplied to the fixing device at the time of warming up and at the time of copying. Moreover, the fixing device is supplied with power also when it is in the standby state for the next copy after being ready. This supply of power in the standby state reduces the user's waiting time until the start of copying, and it is highly convenient. However, power is also consumed in the standby state as well as while copying is being carried out. Moreover, in the conventional color fixing device, in which both the heat roller and the press roller are heated, the power consumption in the standby state may increase.

Thus, in fixing a color toner image with a thick toner layer, by evenly melting the toner image, it is possible to provide uniform image quality without generating a color difference in the fixed image. Moreover, a control method of the fixing device in the image forming apparatus is desired which enables energy saving without losing the convenience for the user.

SUMMARY OF THE INVENTION

Thus, according to an aspect of the invention, as the toner layer of a color toner image with the thick toner layer is heated from above and below, the toner layer is evenly melted and a color difference is prevented, thus providing a stable fixed image. Moreover, a fixing device for an image forming apparatus and a control method thereof are provided which enable reduction of power consumption while fixation is not carried out, and hence energy saving, without losing the convenience for the user waiting long for a fixing operation.

To achieve the above advantage, an aspect of the invention includes an image-side rotating member, a non-image-side rotating member configured to nip and carry a fixing target medium having a toner image thereon into a predetermined direction together with the image-side rotating member, a first heating source configured to heat the image-side rotating member, a second heating source configured to heat the non-image-side rotating member, and a control unit configured to variably control power to be supplied to the first heating source while the image-side rotating member is carrying out an arbitrary operation mode.

DETAILED DESCRIPTION OF THE INVENTION

Figure 1:
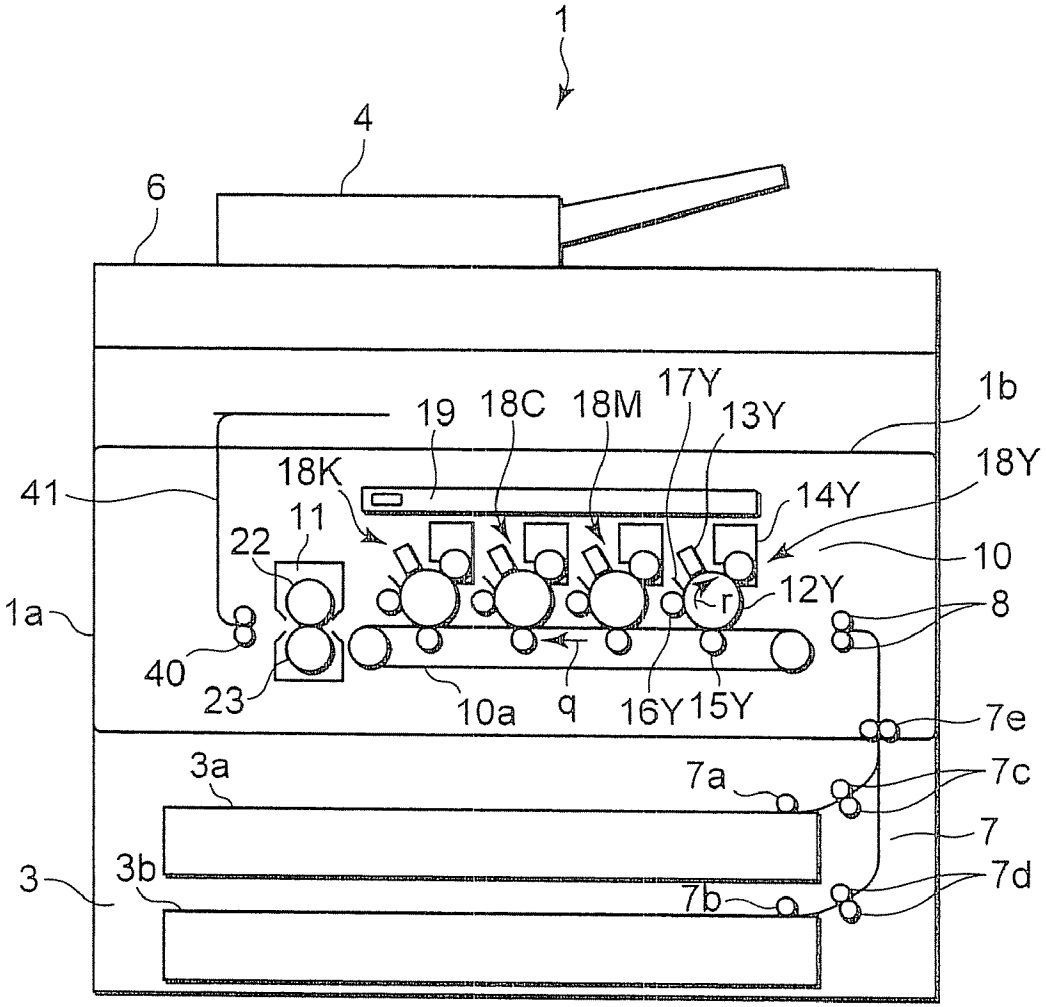
FIG. 1 is schematic configuration view showing an image forming apparatus equipped with a fixing device according to an embodiment of the invention.

Hereinafter, an embodiment of the invention will be described in detail with reference to the accompanying drawings. FIG. 1 is a schematic configuration view showing a color image forming apparatus 1 according to an embodiment of the invention. A scanner unit 6 that reads an original supplied by an automatic document feeder 4 is provided at the top of the color image forming apparatus 1. The color image forming apparatus 1 has a cassette mechanism 3 that supplies a sheet paper P, which is a fixing target medium, to an image forming unit 10.

The cassette mechanism 3 has first and second paper feed cassettes 3*a* and 3*b*. In a carrier path 7 from the paper feed cassettes 3*a*, 3*b* to the image forming unit 10, pickup rollers 7*a*, 7*b* that take out a sheet paper from the paper feed cassettes 3*a*, 3*b*, separation carrier rollers 7*c*, 7*d*, carrier rollers 7*e*, and resist rollers 8 are provided. A fixing device 11 that fixes a toner image that is formed on the sheet paper P by the image forming unit 10 is provided downstream of the image forming unit 10. Paper eject rollers 40 are provided downstream of the fixing device 11, and a paper eject carrier path 41 is provided that carries the sheet paper P after the fixation to a paper eject portion 1*b*.

The image forming unit 10 has image forming stations 18Y, 18M, 18C and 18K for the colors of yellow (Y), magenta (M), cyan (C) and black (K). The image forming stations 18Y, 18M, 18C and 18K are arrayed in tandem along a transfer belt 10*a* turned in the direction of an arrow q.

The yellow (Y) image forming station 18Y is configured with a charger 13Y, a developing device 14Y, a transfer roller 15Y, a cleaner 16Y and an electricity eliminator 17Y, which are process members, arranged around a photoconductive drum 12Y, which is an image carrier rotating in the direction of an arrow r. Also, a laser exposure device 19 that casts a laser beam to the photoconductive drum 12Y is provided above the yellow (Y) image forming station 18Y.

The magenta (M), cyan (C) and black (K) image forming stations 18M, 18C and 18K have a configuration similar to that of the yellow (Y) image forming station 18Y.

In the yellow (Y) image forming station 18Y, the photoconductive drum 12Y, and the charger 13Y, the developing device 14Y, the cleaner 16Y and the electricity eliminator 17Y around the photoconductive drum, form a process cartridge, and it is integrally attachable to and removable from a body l*a*. The configuration of the process cartridge is not limited, as long as at least one of the charger, the developing unit and the cleaner, and the photoconductive drum are integrally supported and attachable to and removable from the body of the image forming apparatus. It can be an arbitrary configuration, for example, a process cartridge in which only a developing unit and a cleaner are integrally provided around a photoconductive drum, and which is integrally attachable to and removable from the body of the image forming apparatus.

As a print operation is started in the image forming unit 10, in the yellow (Y) image forming station 18Y, the photoconductive drum 12Y rotates in the direction of the arrow r and is uniformly charged by the charger 13Y. Then, the photoconductive drum 12Y is irradiated by the laser exposure device 19 with exposure light corresponding to image information read by the scanner unit 6, and an electrostatic latent image is formed thereon. After that, a toner image is formed on the photoconductive drum 12Y by the developing device 14Y, and at the position of the transfer roller 15Y, the toner image is transferred onto the sheet paper P carried in the direction of the arrow q by the transfer belt 10*a*. After the end of the transfer, the photoconductive drum 12Y is cleaned by the cleaner 16Y to remove the remaining toner, and the electricity on the surface of the photoconductive drum 12Y is eliminated by the electricity eliminator 17Y. Thus, the next printing is available.

The magenta (M), cyan (C) and black (K) image forming stations 18M, 18C and 18K carry out the image forming operation similarly to the yellow (Y) image forming station 18Y. The toner images of the respective colors are superimposed and transferred to the sheet paper P and a full-color toner image is formed on the sheet paper P. After that, fixation by heating and pressurizing is carried out on the sheet paper P by the fixing device 11, which is an induction heating fixing device. The print image is completed and the sheet paper is ejected to the paper eject portion 1*b*.

Figure 2:
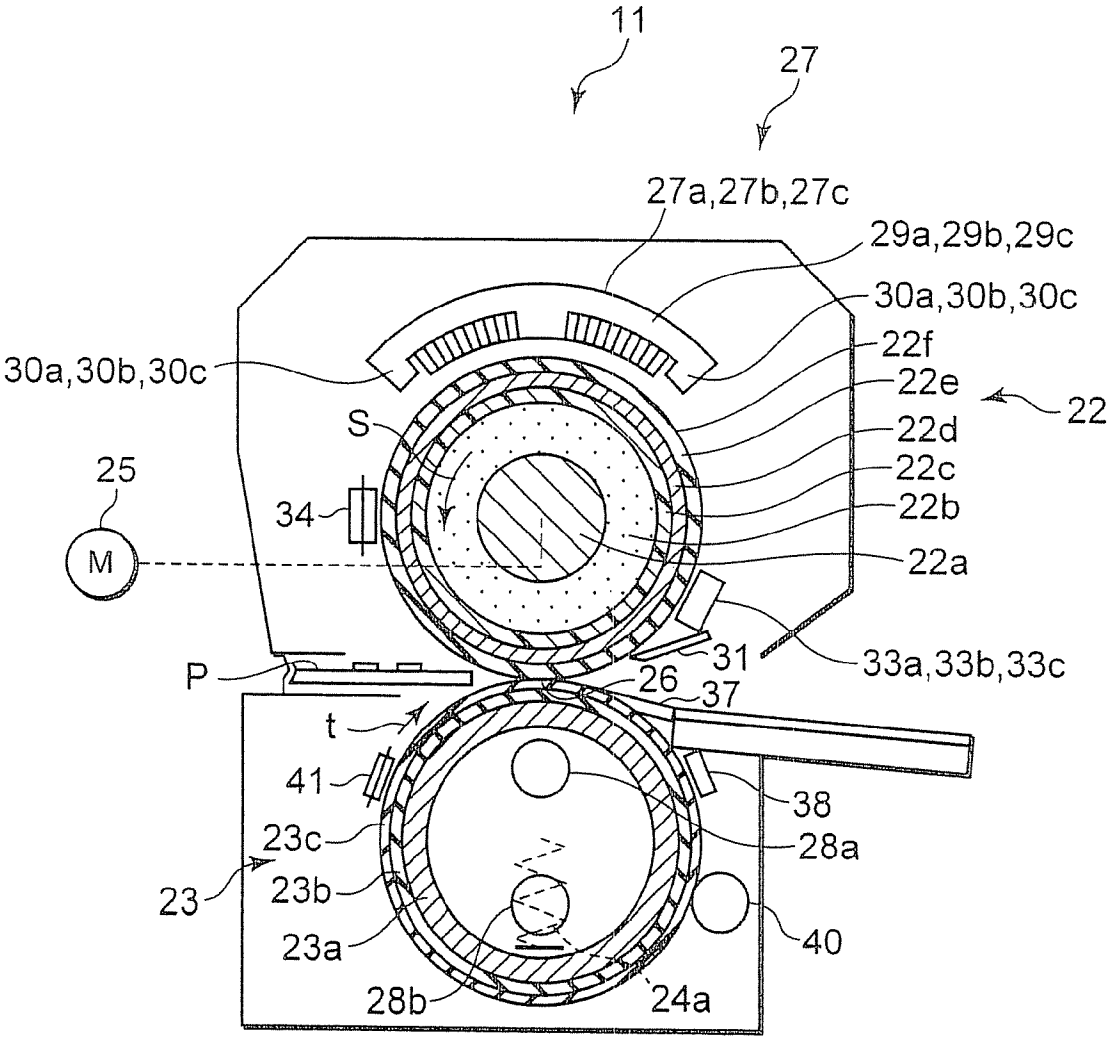
FIG. 2 is a schematic configuration view showing the fixing device according to the embodiment of the invention.
Figure 3:
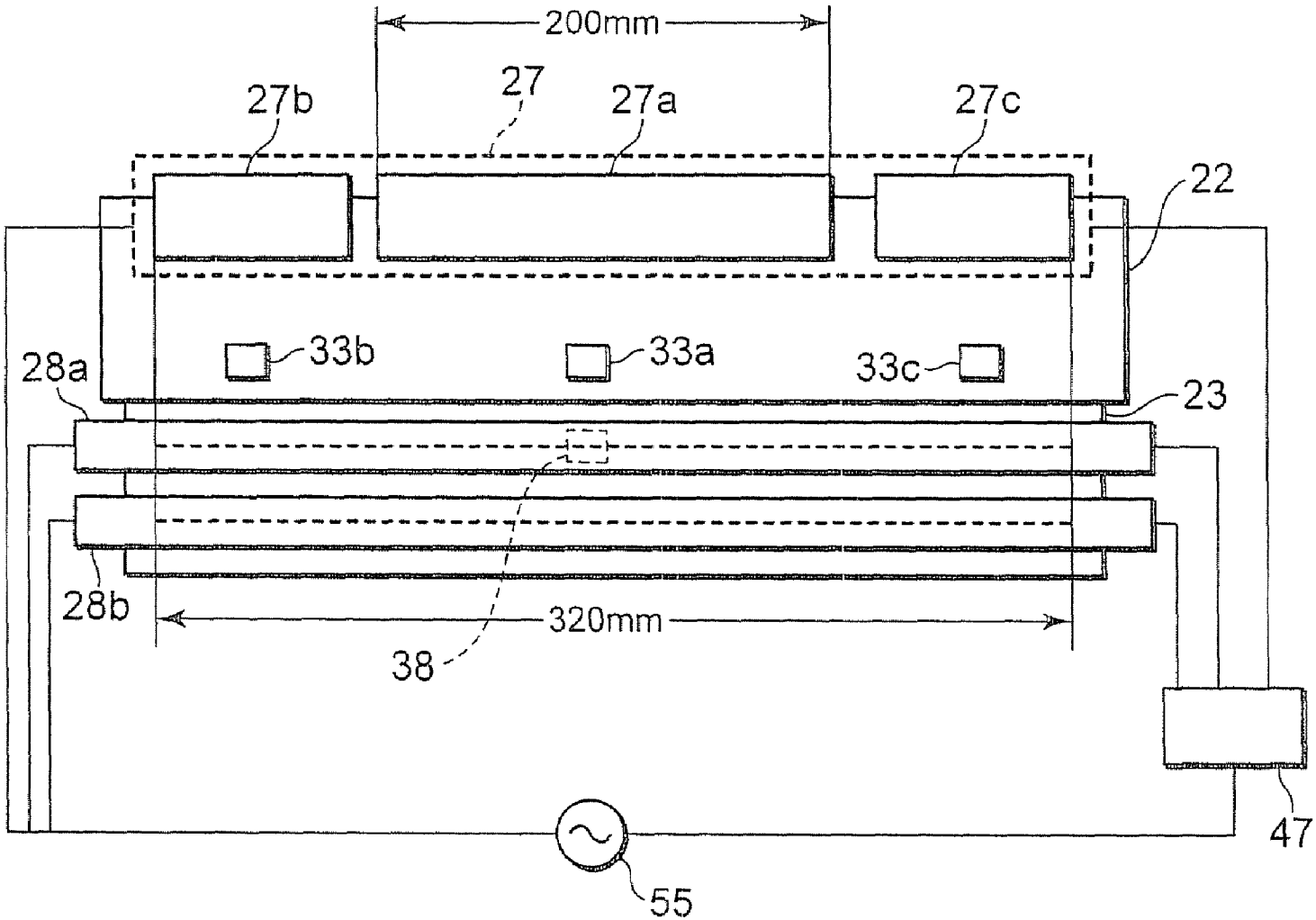
FIG. 3 is an explanatory view showing the fixing device according to the embodiment of the invention, as viewed from its lateral side.

Next, the fixing device 11 will be described. FIG. 2 is a schematic configuration view showing the fixing device 11. FIG. 3 is an explanatory view of the fixing device 11 as viewed from its lateral side. The fixing device 11 has a heat roller 22 with a diameter of 40 mm, which is an image-side rotating member, and a press roller 23 with a diameter of 40 mm, which is a non-image-side rotating member. The heat roller 22 is driven in the direction of an arrow s by a driving motor 25. The press roller 23 is pressed in contact with the heat roller 22 by a pressurizing spring 24*a*. Thus, a nipping part 26 with a predetermined width is formed between the heat roller 22 and the press roller 23. The press roller 23 follows the heat roller 22 and rotates in the direction of an arrow t.

The heat roller 22 includes, around a core metal 22*a*, a foam rubber (sponge) 22*b* formed by continuous bubbles or independent bubbles of silicone rubber with a thickness of 5 mm, a heat-resistant resin layer 22*c*, a metal conductive layer 22*d* with a thickness of 40 μm made of nickel (Ni), a solid rubber layer 22*e* with a thickness of 200 μm, and a separation layer 22*f* with a thickness of 30 μm. The metal conductive layer 22*d* is not limited to nickel and may be made of stainless steel, aluminum, or a composite material of stainless steel and aluminum, and the like.

The press roller 23 is configured with a hollow core metal 23*a* coated with a 0.5-mm thick silicone rubber layer 23*b* and a fluorinated rubber layer 23*c*. As the sheet paper P passes through the nipping part 26 between such heat roller 22 and press roller 23, the toner image on the sheet paper P is fixed by heating and pressurizing. The thickness of the silicone rubber layer 23*b* of the press roller 23 is not limited, but it is preferred that its thickness is as thin as 0.2 to 3 mm so that the temperature difference between the inner side and the outer side of the silicone rubber layer 23*b* is small, in consideration of the thermal conductivity in the case where a heat source is provided in the hollow part of the core metal 23*a*.

In the fixing device 11, an induction heating coil 27, which is a first heating source to heat the heat roller 22, is provided via a gap of about 3 mm over the outer circumference of the heat roller 22. The induction heating coil 27 is substantially coaxial with the heat roller 22. Moreover, a stripping plate 31 supported with a gap of approximately 0.5 mm to the heat roller 22 in order to prevent the sheet paper P as a fixing target medium from being wound after the fixation, first to third thermistors 33*a* to 33*c* as first temperature detection members, and a thermostat 34 that detects anomaly in the surface temperature of the heat roller 22 and interrupts heating, are provided over the outer circumference of the heat roller 22. A stripping pawl may be provided instead of the stripping plate 31, and no stripping plate needs to be arranged if there is no risk of the sheet paper P being wound on the heat roller 22.

The press roller 23 has two halogen lamp heaters, that is, first and second halogen lamp heaters 28*a* and 28*b* as a second heating source in the hollow core metal 23*a*. Both the heating areas of the first and second halogen lamp heaters 28*a* and 28*b* in the axial direction of the press roller 23 are 320-mm long, and each of them heats the fixing area of the press roller 23 across the total length. However, the power consumption of the first halogen lamp heater 28*a* is 300 W, and the power consumption of the second halogen lamp heater 28*b* is 200 W. Thus, on the side of the press roller 23, it is set that maximum power of 500 W can be outputted by the first and second halogen lamp heaters 28*a* and 28*b*.

Over the circumference of the press roller 23, a stripping pawl 37 to strip the sheet paper P from the press roller 23, a fourth thermistor 38 as a second temperature detection member that detects the surface temperature of the press roller, a cleaning member 40, and a thermostat 41 are provided along the rotating direction of the press roller 23. The fourth thermistor 38 detects the temperature of the press roller 23 heated by the first halogen lamp heater 28*a* and/or the second halogen lamp heater 28*b*.

The induction heating coil 27 includes first to third induction heating coils 27*a*, 27*b* and 27*c*. Magnetic cores 29*a*, 29*b* and 29*c* of the first to third induction heating coils 27*a*, 27*b* and 27*c* are substantially coaxial with the heat roller 22. The magnetic cores 29*a*, 29*b* and 29*c* concentrate magnetic fluxes generated by the first to third induction heating coils 27*a*, 27*b* and 27*c* onto the heat roller 22. The magnetic cores 29*a*, 29*b* and 29*c* have magnetic shielding members 30*a*, 30*b* and 30*c* protruding on both sides of them, and thus can further concentrate the magnetic fluxes onto the heat roller 22. The first induction heating coil 27*a* has a length of 200 mm and heats a central area of the heat roller 22. The second and third induction heating coils 27*b* and 27*c* are arranged to both sides of the first induction heating coil 27*a*. The second and third induction heating coils 27*b* and 27*c* are connected in series and are driven under the same control. The first to third induction heating coils 27*a*, 27*b* and 27*c* heat the heat roller 22 across its total length of 320 mm. The first induction heating coil 27*a*, and the second and third induction heating coils 27*b* and 27*c* are caused to alternately make outputs in a switching manner, and each of them is set to be capable of outputting a maximum of 1500 W.

As a high-frequency current is applied, the induction heating coil 27 generates a magnetic flux. This magnetic flux generates an eddy-current in the heat roller 22 in order to prevent a change in the magnetic field. This eddy-current and the resistance of the heat roller 22 generate Joule heat in the metal conductive layer 22*d*, and the heat roller 22 is heated.

For the induction heating coil 27, a Litz wire formed by twisting plural copper wires, each having a diameter of 0.1 to 0.5 mm, is used. As an insulating material for the copper wires, heat-resistance polyamideimide is used. The electric wire and insulating material are not limited these and the wire diameter is arbitrary. The induction heating coil 27 has Litz wires wound on the magnetic cores 29*a*, 29*b* and 29*c*. The distance between the induction heating coil 27 and the heat roller 22 is not limited to 3 mm. As long as it is within the range of approximately 1 to 5 mm, the heat roller 22 can be efficiently heated.

The first thermistor 33*a* detects the temperature of the central part of the heat roller 22 heated by the first induction heating coil 27*a*. The second thermistor 33*b* detects the temperature of the heat roller 22 heated by the second induction heating coil 27*b*. The third thermistor 33*c* detects the temperature of the heat roller 22 heated by the third induction heating coil 27*c*.

Figure 4:
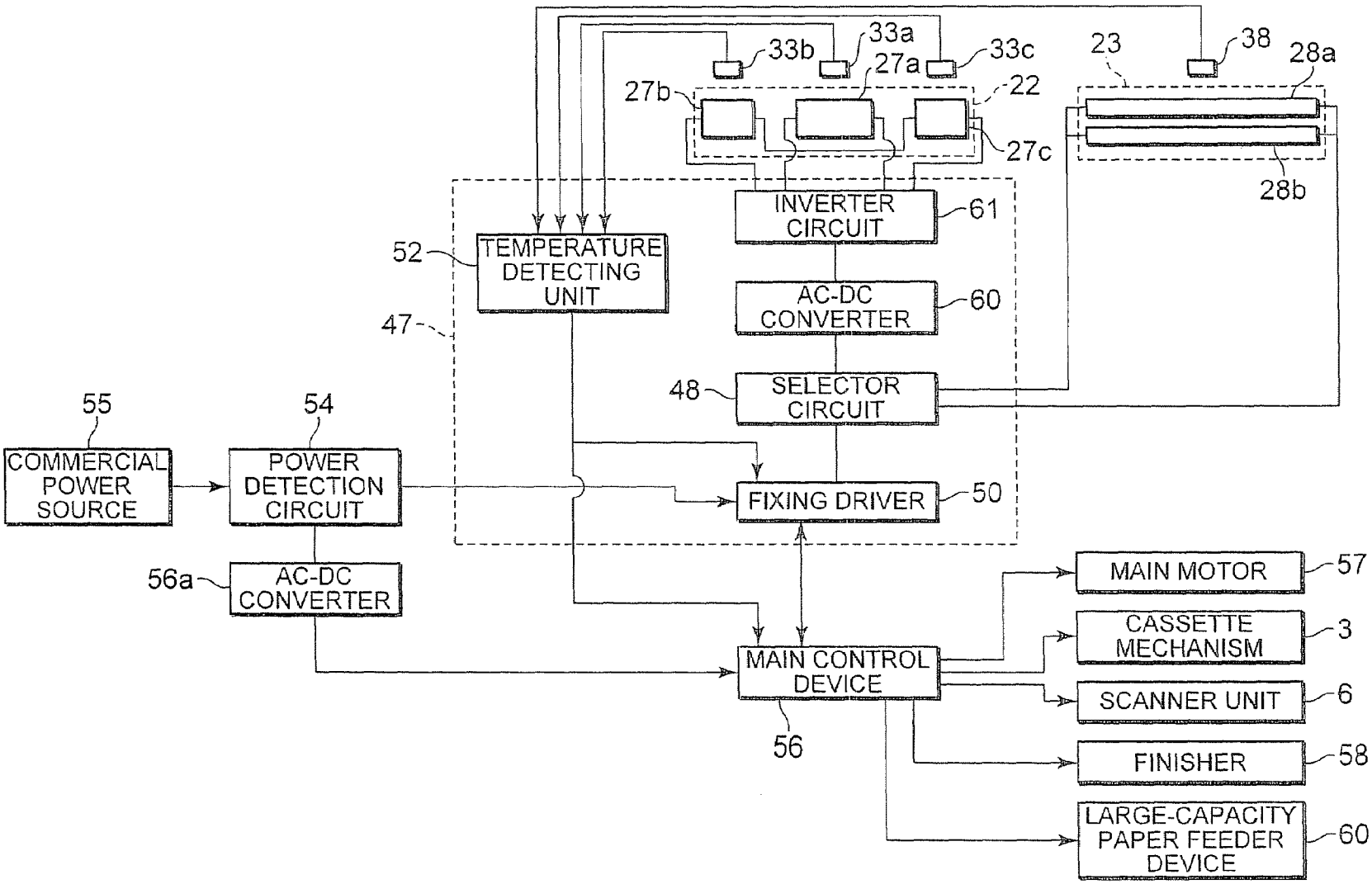
FIG. 4 is a block diagram showing a control unit of the fixing device according to the embodiment of the invention.

Next, a control unit 47, which is a control unit of the fixing device 11, will be described with reference to the block diagram of FIG. 4. The control unit controls power supply to the induction heating coil 27 that heats the heat roller 22, and to the first and second halogen lamp heaters 28*a* and 28*b* that heat the press roller. The induction heating coil 27 is supplied variably with a high-frequency output (current and voltage) by the control unit 47. The first and second halogen lamp heaters 28*a* and 28*b* are supplied respectively with predetermined power by the control unit 47.

The control unit 47 has a selector circuit 48 that enables supply of power to the first induction heating coil 27*a* or the second and third induction heating coils 27*b* and 27*c* and that also enables supply of power to the first and second halogen lamp heaters 28*a* and 28*b*, and a fixing driver 50 that supplies a control signal to the selector circuit 48. The selector circuit 48 supplies a direct current to an inverter circuit 61 via an AC-DC converter 60. The inverter circuit 61 supplies high-frequency power to the first induction heating coil 27*a* or the second and third induction heating coils 27*b* and 27*c*.

The control unit 47 further has a temperature detecting unit 52 connected to the first to third thermistors 33*a* to 33*c* that detect the temperature of the heat roller 22 and to the fourth thermistor 38 that detects the temperature of the press roller 23.

The heating temperature of the heat roller 22 can be adjusted as the electrical quantity outputted from the selector circuit 48 to the first to third induction heating coils 27*a* to 27*c* is controlled in accordance with the result of the detection by the first to third thermistors 33*a* to 33*c*. The heating temperature of the press roller 23 can be adjusted as the output to the first and second halogen lamp heaters 28*a* and 28*b* is switched and controlled in accordance with the result of the detection by the fourth thermistor 38.

The power supplied to the first to third induction heating coils 27*a* to 27*c* and the first and second halogen lamp heaters 28*a* and 28*b* from a commercial power source 55 is constantly monitored by, for example, a power detection circuit 54. The result of monitoring by the power detection circuit 54 is fed back to the fixing driver 50 at a predetermined timing. The output of the power detection circuit 54 is also converted to a direct current by an AC-DC converter 56*a* and is inputted also to a main control device 56 of the color image forming apparatus 1.

The main control device 56 controls a main motor 57, the cassette mechanism 3 and the scanner unit 6 of the color image forming apparatus 1. Additionally, in the case where a finisher 58 or a large-capacity paper feeder device 60 is provided as an option, the main control device 56 controls the finisher 58 or the large-capacity paper feeder device 60. The power consumption of the main motor 57, the paper feeder device 3 and the scanner 4 of the color image forming apparatus 1 is, for example, approximately 200 W. The power consumption of the finisher 58 is, for example, approximately 100 W. The power consumption of the large-capacity paper feeder device 60 is, for example, approximately 100 W.

In the control unit 47, the power detection circuit 54 monitors the power consumption of the color image forming apparatus 1 including the fixing device 11 so that it will not exceed a prescribed power value. That is, in the case where a commercial power source is used, the prescribed power value that can be used in total by the color image forming apparatus 1 is limited to 1500 W. Therefore, the power detection circuit 54 monitors the power consumption so that the quantity of power consumption available to the fixing device 11 will be, at its maximum, the remaining electrical quantity calculated by subtracting the electrical quantity used for the driving source such as the main motor 57 and the electrical quantity used for an optional function such as the finisher 58 from 1500 W. The power detection circuit 54 finds the power consumption to be used for the units other than the fixing device 11, such as the main motor 57 or an optional function, by integrating the input current and voltage flowing into each mechanism.

Next, variable control of power supplied to the first to third induction heating coils 27*a* to 27*c* and the first and second halogen lamp heaters 28*a* and 28*b* in the warming-up mode, copy mode, or copy standby mode in the color image forming apparatus 1 will be described.

(1) Warming-up Mode

In the warming-up mode, after the power source is turned on, power is supplied to the first to third induction heating coils 27*a* to 27*c* and the first and second halogen lamp heaters 28*a* and 28*b*, for example, to set the surface temperature of the heat roller 22 at 160° C. and the surface temperature of the press roller 23 at 130° C. The distribution of power depends on the result of detection by the first to third thermistors 33*a* to 33*c* and the fourth thermistor 38.

In the warming-up mode, the maximum electrical quantity that can be supplied to the fixing device 11 is 1300 W, which is acquired by subtracting the power consumption of 200 W required for the main motor 57, the paper feeder device 3, the scanner 4 and the like, from the prescribed power value of 1500 W of the commercial power source 55. This 1300 W is distributed between the heat roller 22 and the press roller 23. However, the heat roller 22 is given priority in distributing the power. That is, if the heat roller 22 needs 1000 W as the power to be supplied to the first to third induction heating coils 27*a* to 27*c*, the remaining power is 300 W and 300 W is supplied to the press roller 23 to turn on the first halogen lamp heater 28*a*. On the other hand, if the heat roller 22 needs 1100 W as the power to be supplied to the first to third induction heating coils 27*a* to 27*c*, the remaining power is 200 W and the second halogen lamp heater 28*b* is turned on. If the remaining power that is left by the heat roller 22 is less than 200 W, no power is supplied to the press roller 23.

The maximum electrical quantity that can be supplied to the fixing device 11 in the warming-up mode is stored, for example, as data in a memory or the like of the main control device 56. Referring to this data, the power detection circuit 54 distributes the power to be supplied to the heat roller 22 or the press roller 23.

When the first to third induction heating coils 27*a* to 27*c* are supplied with 1000 W, the heat roller 22 of this embodiment reaches 160° C. from 25° C. in about 20 to 30 seconds. Also, the press roller 23 is heated by the first halogen lamp heater 28*a* and reaches 130° C. from 25° C. in about 80 seconds.

If the press roller 23 has not reached 130° C. when the first to third thermistors 33*a* to 33*c* detect that the heat roller 22 has reached 160° C., the distribution of power to the heat roller 22 and the press roller 23 is variably controlled. That is, when the heat roller 22 has reached 160° C. first, which is the warming-up temperature, for example, the power supplied to the first to third induction heating coils 27*a* to 27*c* is lowered by 200 W and to 800 W. On the other hand, on the side of the press roller 23, the second halogen lamp heater 28*b* is supplied with 200 W. Thus, the press roller 23 is heated by the first and second halogen lamp heaters 28*a* and 28*b*, and the time taken for reaching 130° C., which is its warming-up temperature, is made quick. After that, when the press roller 23 has reached the warming-up temperature, the fixing device 11 enters the ready state.

As a result, after the power source is turned on, both the heat roller 22 and the press roller 23 reach the warming-up temperatures in about 30 seconds and the warming-up mode is completed. In this embodiment, the power supplied to the first to third induction heating coils 27*a* to 27*c* and the power supplied to the first and second halogen lamp heaters 28*a* and 28*b* can be variably controlled during the warming-up mode. That is, by properly adjusting the power supply in the warming-up mode in accordance with the properties of the heat roller 22 or the press roller 23, it is possible to shorten the warming-up time.

The control of the power supply to the side of the heat roller 22 or the side of the press roller 23 is not limited and may be arbitrary, such as, causing the heat roller 22 and the press roller 23 to reach the warming-up temperatures simultaneously.

After the heat roller 22 has reached the warming-up temperature, the power supply to the first to third induction heating coils 27*a* to 27*c* may be lowered by an amount equal to or more than the power required by the second halogen lamp heater 28*b*, in order to realize energy saving. However, to prevent a temperature ripple, a proper range of variance of the power supply to the first to third induction heating coils 27*a* to 27*c* is 1500 W or less. After the completion of warming-up, if there is a copy job, the copy mode is immediately started.

(2) Copy Mode

In the copy mode, the surface temperature of the heat roller 22 is maintained at 160±10° C. and the surface temperature of the press roller 23 is maintained at 130±15° C. It is assumed that the color image forming apparatus 1 has, for example, the finisher 58 and the large-capacity paper feeder device 60 as optional functions. In this case, in the copy mode, the maximum electrical quantity that can be supplied to the fixing device 11 is 1100 W, which is acquired by subtracting the power consumption of 200 W required for the main motor 57, the paper feeder 3, the scanner 4 and the like, and the power consumption of 200 W required for the finisher 58 and the large-capacity paper feeder device 60 from the prescribed power value of 1500 W of the commercial power source 55. Therefore, the power supply to the first to third induction heating coils 27*a* to 27*c* on the side of the heat roller 22 and the first and second halogen lamp heaters 28*a* and 28*b* on the side of the press roller 23 is variably controlled within this range to optimize the power supply. Also the maximum electrical quantity that can be supplied to the fixing device 11 in the copy mode is stored as data in the memory or the like of the main control device 56. The maximum electrical quantity that can be supplied to the fixing device 11 in the copy mode varies depending on the presence or absence of optional functions of the color image forming apparatus 1.

For example, in the case of fixation on a sheet paper P of JIS standard B4 size, the first to third induction heating coils 27*a* to 27*c* are supplied with 800 W, and the first halogen lamp heater 28*a* is supplied with 300 W. While copying is carried out, the power supply is variably controlled in accordance with the result of temperature detection by the first to third thermistors 33*a* to 33*c* or the fourth thermistor 38. On the side of the heat roller 22, the power supplied to the first to third induction heating coils 27*a* to 27*c* is variably controlled. On the side of the press roller 23, the power supply is variably controlled, for example, by supplying power to the second halogen lamp heater 28*b* in addition to the first halogen lamp heater 28*a*. However, to prevent a temperature ripple on the side of the press roller 23, it is preferred that the range of variance of the power supply is 500 W or less.

Similarly, for example, in the case of fixation on a sheet paper P of JIS standard A4 size, first, only the first induction heating coil 27*a* is supplied with 800 W and the second halogen lamp heater 28*b* is supplied with 200 W. While copying is carried out, the power supply is variably controlled in accordance with the result of temperature detection by the first thermistor 33*a* or the fourth thermistor 38.

On the side of the heat roller 22, the power supplied to the first induction heating coil 27*a* is variably controlled. However, if, on the side of the heat roller 22, the temperature detected by the second or third thermistor 33*b* or 33*c* has become 100° C. or less, which is the surface temperature in the copy standby mode, the second and third induction heating coils 27*b* and 27*c* as well as the first induction heating coil 27*a* is supplied with power.

On the side of the press roller 23, the power supply is variably controlled, for example, by switching the power supply from the second halogen lamp heater 28*b* to the first halogen lamp heater 28*a*, or supplying power to both the first and second halogen lamp heaters 28*a* and 28*b*, as long as the prescribed power value of the commercial power source 55 is not exceeded.

Also in the copy mode, as in the warming-up mode, the power supply to the side of the heat roller 22 and the side of the press roller 23 can be variably controlled. The variable control of the power supply enables proper adjustment of the temperature of the heat roller 22 or the press roller 23 during the copy mode. Therefore, the temperature of the heat roller 22 or the press roller 23 can be finely controlled, and even for a full-color toner image with a thick layer, the toner layer can be melt constantly in the uniform state. As a result, the color difference for each copy can be reduced and a fixed color image of stable image quality can be provided.

As in the warming-up mode, the range of variance of the power supply to the first to third induction heating coils 27*a* to 27*c* is arbitrary. However, to prevent a temperature ripple, a proper range of variance of the power supply to the first to third induction heating coils 27*a* to 27*c* is 1500 W or less. After the copying has ended, the apparatus enters the standby mode or copy standby mode.

(3) In the copy standby mode, the surface temperature of the heat roller 22 is maintained at 100° C. and the surface temperature of the press roller 23 is maintained at 80° C. As the heat roller 22 and the press roller 23 are thus maintained at low temperatures in the copy standby mode, energy saving can be realized. Also, when a copy job is requested, the time taken for reaching the copy enabling temperature by warming up can be short and convenience for the user can be improved.

In the copy standby mode, in the case where the finisher 58 and the large-capacity paper feeder device 60 are provided, the maximum electrical quantity that can be supplied to the fixing device 11 is 1100 W. Therefore, the power supply to the heat roller 22 and the press roller 23 is variably controlled to maintain the copy standby temperature in accordance with the result of temperature detection by the first to third thermistors 33*a* to 33*c* or the fourth thermistor 38. Also the maximum electrical quantity that can be supplied to the fixing device 11 in the copy standby mode is stored as data in the memory or the like of the main control device 56.

For example, after the end of copying, first, both the power supply to the first to third induction heating coils 27*a* to 27*c* and the first and second halogen lamp heaters 28*a* and 28*b* are turned off. When the temperature of the heat roller 22 and the press roller 23 has become less than the temperature in the copy standby mode with the lapse of time, the first to third induction heating coils 27*a* to 27*c* are supplied with 300 W and the second halogen lamp heater 28*b* is supplied with 200 W. After that, the power supply to the side of the heat roller 22 and the side of the press roller 23 is suitably and variably controlled in accordance with the result of temperature detection by the first to third thermistors 33*a* to 33*c* or the fourth thermistor 38. This enables proper adjustment of the temperature of the heat roller 22 and the press roller 23 also in the copy standby mode. The temperature setting of the heat roller 22 and the press roller 23 in the copy standby mode is arbitrary. The temperature can be set to avoid having the user wait for long until the completion of warming-up and to realize energy saving more effectively.

The copy standby mode need not be provided, for example, in an apparatus that takes a short time of approximately 30 seconds until the completion of warming-up from room temperatures and thus does not lower the convenience to the user. In this case, the power supply to the heat roller 22 and the press roller 23 is stopped in the normal state. When a copy job is requested, the above warming-up mode is carried out, and the above copy mode is carried out immediately after the completion of the warming-up.

According to this embodiment, in each mode of the fixing device 11 of the color image forming apparatus 1, the power supplied to the first to third induction heating coils 27*a* to 27*c* or the first and second halogen lamp heaters 28*a* and 28*b* is variably controlled in accordance with the temperature of the heat roller 22 and the press roller 23. Therefore, in the warming-up mode, the warming-up time can be shortened and convenience for the user can be improved. Also, in the copy mode, fine temperature control of the heat roller 22 or the press roller 23 enables melting of a thick toner layer in a uniform state, and the color difference for each copy is reduced to provide a fixed color image of uniform image quality. Moreover, in the copy standby mode, energy saving is realized without lowering the convenience for the user.

This invention is not limited to the above embodiment and various changes can be made within the scope of the invention. For example, the shape and structure of the image-side rotating member or the non-image-side rotating member are not limited and they may be endless belts or the like. The first or second heating source is not limited, either. For example, as the first heating source, the structure, heating area and the like of the induction heating coil are not limited. Also, instead of the induction heating coil, the first heating source may be plural halogen lamp heaters with different quantities of power consumption and heating areas, provided within the image-side rotating member. In an arbitrary operation mode, the temperature of the image-side rotating member can also be adjusted properly by variable control of the power supply to the image-side rotating member to switch the halogen lamp heater to be used. Similarly, an induction heating coil, infrared heater or the like may be used as the second heating source.

What is claimed is:

1. A fixing device for an image forming apparatus comprising:

an image-side rotating member;

a non-image-side rotating member configured to nip and carry a fixing target medium having a toner image thereon into a predetermined direction together with the image-side rotating member;

a first heating source which is supplied with power by using a commercial power source configured to heat the image-side rotating member;

a second heating source which is supplied with power by using a commercial power source configured to heat the non-image-side rotating member; and a control unit configured to variably control power to be supplied to the first heating source and power to be supplied to the second heating source so that a sum value of the power to be supplied to the first heating source and the power to be supplied to the second heating source does not exceed a prescribed power value of the commercial power source while the image-side rotating member is carrying out an arbitrary operation mode, wherein the power to be supplied to the first heating source is given priority.

2. A fixing device for an image forming apparatus comprising:

an image-side rotating member for heating a side of a fixing target medium on which a toner image is formed;

a non-image-side rotating member nipping and carrying the fixing target medium into a predetermined direction together with the image-side rotating members, and contacting a side of the fixing target medium on which the toner image is not formed;

a first heating source for heating the image-side rotating member;

a second heating source for heating the non-image-side rotating member; and a control unit configured to variably control power to be supplied to the first heating source and power to be supplied to the second heating source so that a sum value of the power to be supplied to the first heating source, the power to be supplied to the second heating source does not exceed a prescribed power value of a commercial power source and the power to be supplied to the first heating source is given priority while the image-side rotating member is carrying out an arbitrary operation mode.

3. The fixing device for an image forming apparatus according to claim 2, wherein a maximum value of the sum value is set for each operation mode of the image-side rotating member.

4. The fixing device for an image forming apparatus according to claim 2, further comprising a first temperature detecting member for the image-side rotating member and a second temperature detecting member for the non-image-side rotating member, wherein the control unit variably controls the power to be supplied to the first heating source in accordance with a first detection result by the first temperature detecting member, and variably controls the power to be supplied to the second heating source in accordance with a second detection result by the second temperature detecting member.

5. The fixing device for an image forming apparatus according to claim 1, wherein a maximum value of the sum value is set for each operation mode of the image-side rotating member.

6. The fixing device for an image forming apparatus according to claim 1, further comprising a first temperature detecting member for the image-side rotating member and a second temperature detecting member for the non-image-side rotating member, wherein the control means variably controls the power to be supplied to the first heating source in accordance with a first detection result by the first temperature detecting member, and variably controls the power to be supplied to the second heating source in accordance with a second detection result by the second temperature detecting member.

7. The fixing device for an image forming apparatus according to claim 1, wherein the first heating source is an induction heating coil or plural halogen lamp heaters.

8. The fixing device for an image forming apparatus according to claim 1, wherein a range of variance of the power of the first heating source by the control unit is 1500 W or less.

9. The fixing device for an image forming apparatus according to claim 1, wherein the second heating source is an induction heating coil, plural halogen lamp heaters, or plural infrared heaters.

10. The fixing device for an image forming apparatus according to claim 1, wherein a range of variance of the power of the second heating source by the control unit is 500 W or less.

11. The fixing device for an image forming apparatus according to claim 2, wherein the first heating source is an induction heating coil or plural halogen lamp heaters.

12. The fixing device for an image forming apparatus according to claim 2, wherein a range of variance of the power of the first heating source by the control unit is 1500 W or less.

13. The fixing device for an image forming apparatus according to claim 2, wherein the second heating source is an induction heating coil, plural halogen lamp heaters, or plural infrared heaters.

14. The fixing device for an image forming apparatus according to claim 2, wherein a range of variance of the power of the second heating source by the control unit is 500 W or less.

15. A control method of a fixing device for an image forming apparatus comprising:

nipping and carrying a fixing target medium having a toner image thereon into a predetermined direction together with the image-side rotating member heated by a first heating source and a non-image-side rotating member heated by a second heating source;

controlling a power to be supplied to the first heating source variably while the image-side rotating member is carrying out an arbitrary operation mode;

controlling the power to be supplied to the second heating source variably while the non-image-side rotating member is carrying out an arbitrary operation mode;

supplying the power to the first heating source and the second heating source by using a commercial power source; and controlling a sum value of the power to be supplied to the first heating source and the power to be supplied to the second heating source does not exceed a prescribed power value and the power to be supplied to the first heating source is given priority, at the time of variable control of power consumption of the first heating source or at the time of variable control of power consumption of the second heating source.

16. The control method of a fixing device for an image forming apparatus according to claim 15, wherein a maximum value of the sum value is set for each operation mode of the image-side rotating member.

17. The control method of a fixing device for an image forming apparatus according to claim 15, wherein the power to be supplied to the first heating source is variably controlled in accordance with a first detection result by a first temperature detecting member of the image-side rotating member, and the power to be supplied to the second heating source is variably controlled in accordance with a second detection result by a second temperature detecting member of the non-image-side rotating member.

18. The control method of a fixing device for an image forming apparatus according to claim 15, wherein a range of variance of the power of the first heating source is 1500 W or less.

19. The control method of a fixing device for an image forming apparatus according to claim 15, wherein a range of variance of the power of the second heating source is 500 W or less.

* * * * *